US010730681B2

(12) United States Patent
Franca et al.

(10) Patent No.: US 10,730,681 B2
(45) Date of Patent: Aug. 4, 2020

(54) MICROCAPILLARY FLUID ABSORBING SHEET

(71) Applicant: Dow Global Technologies LLC, Midland, MI (US)

(72) Inventors: Marcos P. Franca, Sao Paulo (BR); Bruno R. Pereira, Sao Paulo (BR); Wenyi Huang, Midland, MI (US); Susan L. Jordan, Collegeville, PA (US); Jaime L. Curtis-Fisk, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 1001 days.

(21) Appl. No.: 15/057,257

(22) Filed: Mar. 1, 2016

(65) Prior Publication Data

US 2017/0253410 A1 Sep. 7, 2017

(51) Int. Cl.
*B65D 81/26* (2006.01)
*B65D 65/42* (2006.01)

(52) U.S. Cl.
CPC ..... *B65D 81/264* (2013.01); *B65D 65/42* (2013.01)

(58) Field of Classification Search
CPC ..... B65D 33/01; B65D 81/263; B65D 5/4295
See application file for complete search history.

(56) References Cited

U.S. PATENT DOCUMENTS

| | | | |
|---|---|---|---|
| 4,382,507 A | 5/1983 | Miller | |
| 5,482,724 A | 1/1996 | Morici et al. | |
| 8,241,495 B2 | 8/2012 | Aerts et al. | |
| 8,833,611 B2 | 9/2014 | Bouwer | |
| 2003/0203080 A1* | 10/2003 | Garavaglia | B65D 1/48 426/127 |
| 2004/0142124 A1 | 7/2004 | Patterson | |
| 2004/0157051 A1 | 8/2004 | Trent | |
| 2009/0011182 A1 | 1/2009 | Mackley et al. | |
| 2011/0020574 A1 | 1/2011 | Mackley et al. | |
| 2013/0288016 A1 | 10/2013 | Koopmans et al. | |
| 2014/0072776 A1 | 3/2014 | Zalamea et al. | |
| 2014/0113112 A1 | 4/2014 | Koopmans et al. | |
| 2015/0315345 A1 | 11/2015 | Zalamea Bustillo et al. | |
| 2015/0321407 A1 | 11/2015 | Dooley et al. | |

FOREIGN PATENT DOCUMENTS

| | | |
|---|---|---|
| AU | 2011101539 A4 | 1/2012 |
| DE | 2427263 A1 | 1/1975 |
| EP | 0359897 A1 | 3/1990 |
| EP | 0849309 A1 | 6/1998 |
| JP | 2003-267455 A | 9/2003 |
| WO | 2015/123031 A1 | 8/2015 |

* cited by examiner

*Primary Examiner* — Erik Kashnikow
*Assistant Examiner* — Lela S. Williams
(74) *Attorney, Agent, or Firm* — Quarles & Brady LLP

(57) ABSTRACT

The present disclosure provides a food package. In an embodiment, the food package includes a microcapillary sheet having a first end and a second end and opposing surfaces. The microcapillary sheet includes a matrix composed of a polymeric material and a plurality of channels. The channels are disposed in parallel in the matrix and between the opposing surfaces. The channels extend from the first end to the second end of the microcapillary sheet. The microcapillary sheet includes a perforation traversing at least two channels. The perforation extends from a surface of the microcapillary sheet and through a wall of the at least two channels.

20 Claims, 7 Drawing Sheets

MICROCAPILLARY FLUID ABSORBING SHEET

BACKGROUND

The present disclosure is directed to microcapillary sheets having microcapillary channels that control liquid in food packaging.

Many fresh foods such as such as meat, poultry, fish, vegetables and fruits are packaged in plastic trays with a shrink or stretch wrap film for protection, unitization and transportation. These trays are typically thermoformed trays made from rigid- or semi-rigid materials such as polystyrene or polypropylene sheets. The fresh food item typically contains liquid that drains or flows from the food item during storage. The liquid accumulates in the bottom of the package. Liquid accumulation increases the risk of microbiological growth, which can deteriorate the fresh food, rendering unsafe for consumption. Liquid accumulation in the fresh food package also negatively impacts the appearance of the food item, steering consumers away from purchasing the food item.

Conventional fresh food packaging utilizes an absorbent pad between the food item and the tray. Absorbent pads are typically made of cellulose pulp and/or super absorbent polyacrylates, encased in a non-woven textile wrapping bag. Absorbent pads can only retain the drained liquid to a limited extent. Absorbent pads do not completely eliminate microbiological growth inside of the food package because the liquid remains in contact with the food item at the interface of the absorbent pad. Also, the liquid in the absorbent pad remains in either liquid or hydrogel form, increasing the risk of microbiological growth. Biocides cannot typically be used inside of absorbent packages or absorbent pads due to food contact regulations. Further, absorbent pads are known to easily tear and/or adhere to a food item when consumers remove the food item from a package, forcing consumers to contact the absorbent pad.

The art recognizes the need for a food package that is capable of preventing liquid accumulation and minimizing microbiological growth without the need for an absorbent pad.

SUMMARY

The present disclosure provides a food package. In an embodiment, the food package includes a microcapillary sheet having a first end and a second end and opposing surfaces. The microcapillary sheet includes a matrix composed of a polymeric material and a plurality of channels. The channels are disposed in parallel in the matrix and between the opposing surfaces. The channels extend from the first end to the second end of the microcapillary sheet. The microcapillary sheet includes a perforation traversing at least two channels. The perforation extends from a surface of the microcapillary sheet and through a wall of the at least two channels.

In another embodiment, the food package includes a tray with a base and a plurality of walls extending upward from the base. The tray is formed from a microcapillary sheet having a first end and a second end and opposing surfaces. The microcapillary sheet includes a matrix composed of a polymeric material and a plurality of channels. The channels are disposed in parallel in the matrix and between the opposing surfaces. The channels extend from the first end to the second end of the microcapillary sheet. The microcapillary sheet includes a perforation traversing at least two channels. The perforation extends from a surface of the microcapillary sheet and through a wall of the at least two channels. A trough extends along a perimeter of the base.

DEFINITIONS

Figure 1:
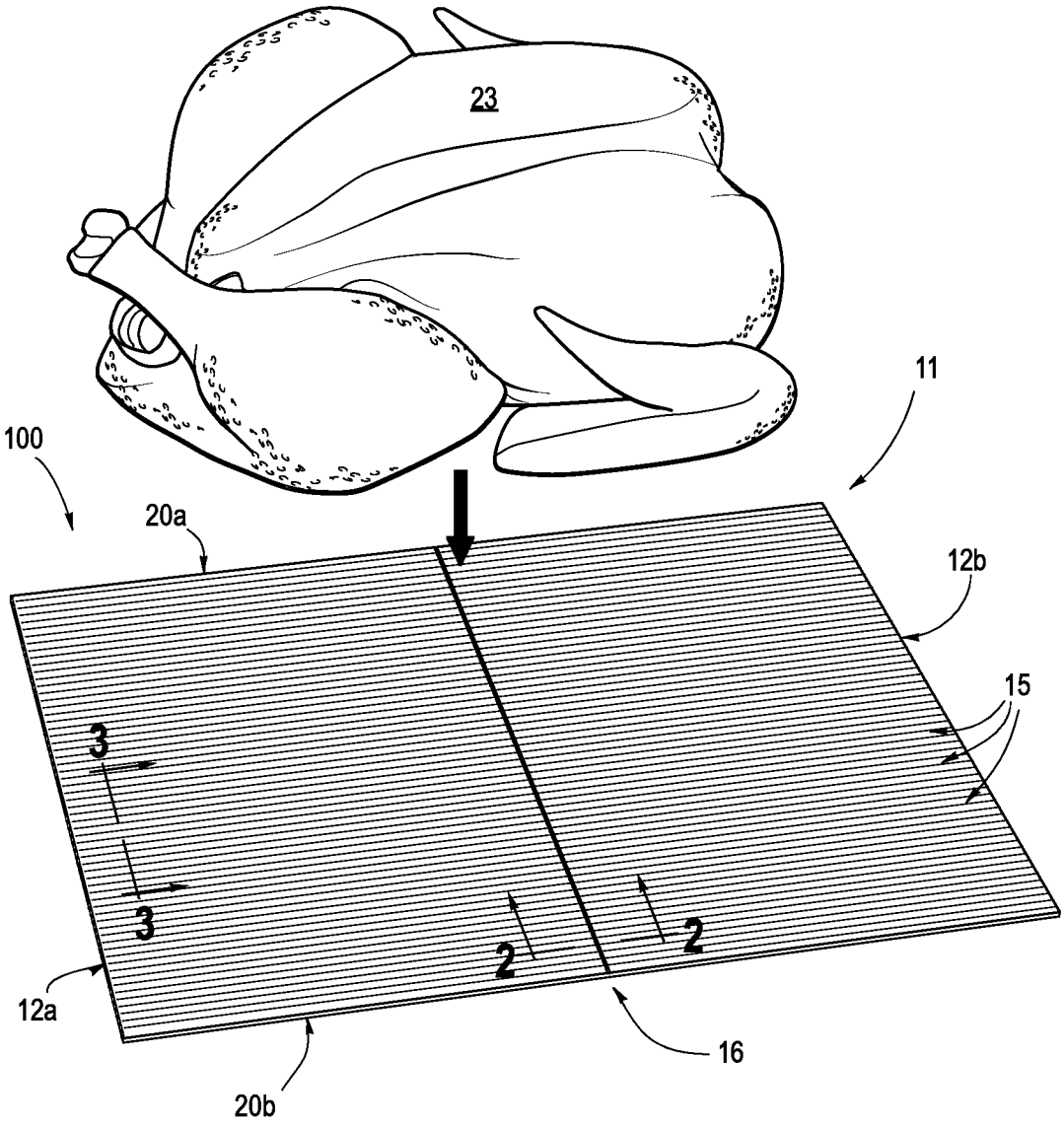
FIG. 1 is a perspective view of a food package with a microcapillary sheet in accordance with an embodiment of the present disclosure.

Any reference to the Periodic Table of Elements is that as published by CRC Press, Inc., 1990-1991. Reference to a group of elements in this table is by the new notation for numbering groups.

For purposes of United States patent practice, the contents of any referenced patent, patent application or publication are incorporated by reference in their entirety (or its equivalent US version is so incorporated by reference) especially with respect to the disclosure of definitions (to the extent not inconsistent with any definitions specifically provided in this disclosure) and general knowledge in the art.

The numerical ranges disclosed herein include all values from, and including, the lower and upper value. For ranges containing explicit values (e.g., 1 or 2; or 3 to 5; or 6; or 7), any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight and all test methods are current as of the filing date of this disclosure.

The term "composition" refers to a mixture of materials which comprise the composition, as well as reaction products and decomposition products formed from the materials of the composition.

The terms "comprising," "including," "having" and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term "consisting essentially of" excludes from the scope of any succeeding recitation any other component, step, or procedure, excepting those that are not essential to operability. The term "consisting of" excludes any component, step, or procedure not specifically delineated or listed. The term "or," unless stated otherwise, refers to the listed members individually as well as in any combination. Use of the singular includes use of the plural and vice versa.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

An "olefin-based polymer" or "polyolefin" is a polymer that contains more than 50 mole percent polymerized olefin monomer (based on total amount of polymerizable monomers), and optionally, may contain at least one comonomer. Nonlimiting examples of olefin-based polymer include ethylene-based polymer and propylene-based polymer.

An "ethylene-based polymer" is a polymer that contains more than 50 mole percent polymerized ethylene monomer (based on the total amount of polymerizable monomers) and, optionally, may contain at least one comonomer.

A "propylene-based polymer" is a polymer that contains more than 50 mole percent polymerized propylene monomer (based on the total amount of polymerizable monomers) and, optionally, may contain at least one comonomer.

DETAILED DESCRIPTION

The present disclosure provides a food package. In an embodiment, the food package includes a microcapillary sheet having a first end and a second end and opposing surfaces. The microcapillary sheet includes a matrix composed of a polymeric material and a plurality of channels. The channels are disposed in parallel in the matrix and between the opposing surfaces. The channels extend from the first end to the second end of the microcapillary sheet. The microcapillary sheet includes a perforation traversing at least two channels. The perforation extends from a surface of the microcapillary sheet and through a wall of the at least two channels.

1. Microcapillary Sheet

Figure 2:
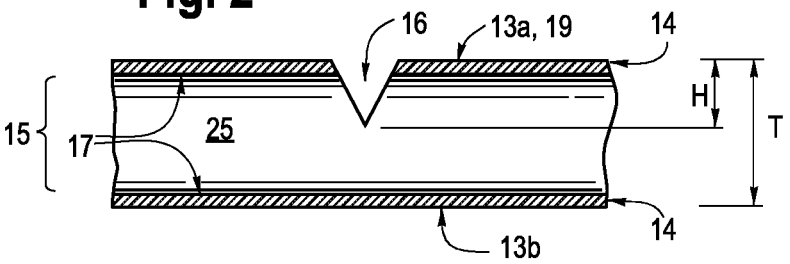
FIG. 2 is a cross-sectional view of the microcapillary sheet taken along line 2-2 of FIG. 1 in accordance with an embodiment of the present disclosure.
Figure 2A:
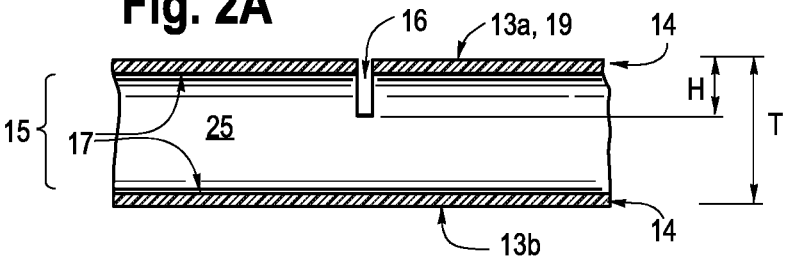
FIG. 2A is a cross-sectional view of the microcapillary sheet taken along line 2-2 of FIG. 1 in accordance with another embodiment of the present disclosure.
Figure 2B:
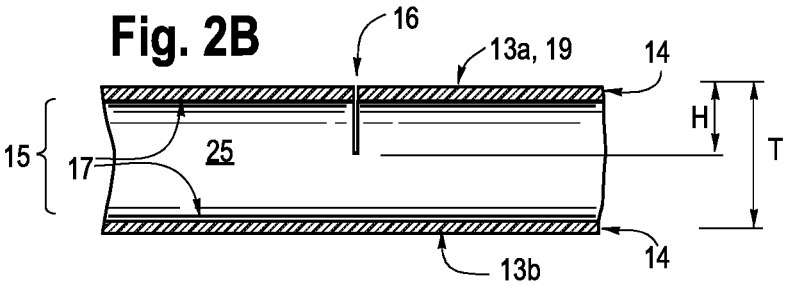
FIG. 2B is a cross-sectional view of the microcapillary sheet taken along line 2-2 of FIG. 1 in accordance with another embodiment of the present disclosure.
Figure 3:
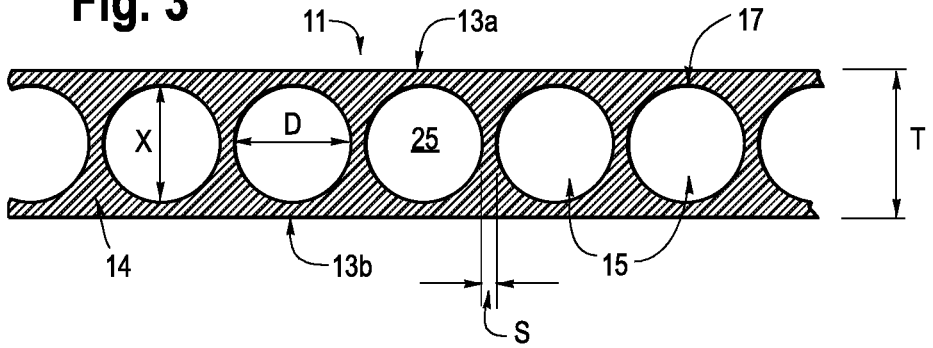
FIG. 3 is a cross-sectional view of the microcapillary sheet taken along line 3-3 of FIG. 1 in accordance with an embodiment of the present disclosure.
Figure 3A:
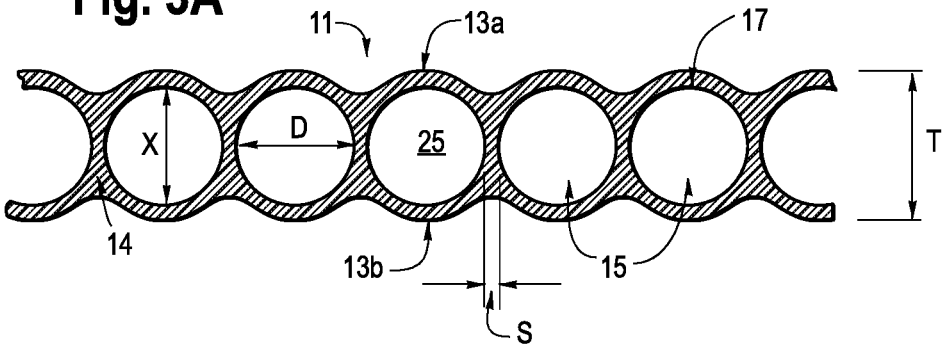
FIG. 3A is a cross-sectional view of the microcapillary sheet taken along line 3-3 of FIG. 1 in accordance with another embodiment of the present disclosure.

The food package (100, 200) includes a microcapillary sheet. FIGS. 1-3A depict various views of a microcapillary sheet 11. The microcapillary sheet has a first end 12*a* and a second end 12*b*, as shown in FIG. 1. The microcapillary sheet has opposing surfaces 13*a* and 13*b*, as shown in FIGS. 2, 3 and 3A. The microcapillary sheet 11 includes a matrix 14 and a plurality of channels 15. The channels 15 are disposed in parallel in the matrix 14 and between the opposing surfaces (13*a*, 13*b*), as shown in FIGS. 1 and 3. The channels 15 extend from the first end 12*a* to the second end 12*b* of the microcapillary sheet. The microcapillary sheet includes a perforation 16 traversing at least two channels 15, as shown in FIG. 1. The perforation extends from a surface 13*a* of the microcapillary sheet 11 through a wall 17 of the at least two channels 15, as shown in FIGS. 1 and 2-2B.

In an embodiment, the opposing surfaces 13*a* and 13*b* of the microcapillary sheet 11 are flat, considering the microcapillary sheet 11 in a horizontal position, as shown in FIG. 3. In a further embodiment, the opposing surfaces 13*a* and 13*b* of the microcapillary sheet 11 are corrugated, as shown in FIG. 3A. A "corrugated" surface has an undulating shape from a cross-sectional view. In an embodiment, the opposing surfaces (13*a*, 13*b*) of the microcapillary sheet 11 are flat, corrugated, or a combination thereof.

In an embodiment, the microcapillary sheet 11 has a first side 20*a* and an opposing second side 20*b*, as shown in FIG. 1.

A. Matrix

As shown in FIGS. 3 and 3A, the microcapillary sheet 11 includes a matrix 14. The matrix 14 includes a polymeric material. Nonlimiting examples of suitable polymeric materials include polyamides ("Nylon"); polylactic acid ("PLA"); ethylene vinyl alcohol copolymer ("EVOH"), polycarbonate; styrene acrylonitrile ("SAN"); polyolefins; ethylene vinyl acetate ("EVA") copolymers; polystyrene; polyvinyl chloride ("PVC"); polyethylene terephthalate ("PET"); ethylene-acrylic acid or ethylene-methacrylic acid and their ionomers with zinc, sodium, lithium, potassium, magnesium salts; and combinations thereof. In an embodiment, the polymeric material is a polyolefin. In a further embodiment, the polyolefin is an ethylene-based polymer, a propylene-based polymer, or combinations thereof. In an embodiment, the polyolefin may be blended with a functional polymer such as ethylene acrylic acid copolymers and/or graft copolymers such as graft maleic anhydride.

In an embodiment, the matrix 14 includes an ethylene-based polymer. Nonlimiting examples of suitable ethylene-based polymer include ethylene/α-olefin copolymers, high density polyethylene ("HDPE"), low density polyethylene ("LDPE"), linear low density polyethylene ("LLDPE"), medium density polyethylene "MDPE") and combinations thereof.

In an embodiment, the matrix 14 includes an ethylene/α-olefin copolymer. Representative α-olefins include, but are not limited to, $C_3$-$C_{20}$ α-olefins, or $C_3$-$C_{10}$ α-olefins, or $C_4$-$C_{20}$ α-olefins, or $C_4$-$C_{10}$ α-olefins. Representative α-olefins include propylene, 1-butene, 1-pentene, 1-hexene, 1-heptene and 1-octene. In an embodiment, the matrix 14 includes an ethylene/1-octene copolymer. Commercially available ethylene/α-olefin copolymers include but are not limited to ELITE™ resins available from The Dow Chemical Company, including ELITE™ 5100G. In an embodiment, the ethylene/α-olefin copolymer has a density from 0.880 g/cc, or 0.900 g/cc, or 0.910 g/cc, or 0.920 g/cc, or 0.930 g/cc to 0.940 g/cc, or 0.950 g/cc, or 0.960 g/cc, or 0.970 g/cc, or 0.980 g/cc, or 0.990 g/cc. In an embodiment, the ethylene/α-olefin copolymer has a melt index from 0.1 g/10 min, or 0.5 g/10 min, or 0.8 g/10 min to 1.0 g/10 min, or 2.0 g/10 min, or 4.0 g/10 min, or 12.0 g/10 min, or 25 g/10 min.

In an embodiment, the matrix 14 includes HDPE. A "high density polyethylene" (or "HDPE") is an ethylene-based polymer having a density of at least 0.940 g/cc, or from at least 0.940 g/cc to 0.980 g/cc. The HDPE has a melt index from 0.1 g/10 min to 25 g/10 min.

In an embodiment, the matrix 14 includes LDPE. A "low density polyethylene" (or "LDPE") is an ethylene-based polymer having a density of 0.915 to 0.922 g/cc, or 0.925 g/cc. The LDPE has a melt index of 0.15 g/10 min, or 1.5 g/10 min to 4.0 g/10 min. Commercially available LDPE resins include but are not limited to DOW Low Density Polyethylene resins available from The Dow Chemical Company, including LDPE 501I.

In an embodiment, the matrix 14 includes a propylene-based polymer. Nonlimiting examples of suitable propylene-based polymers include propylene homopolymers, random propylene copolymers, propylene impact copolymers, propylene/α-olefin copolymers and combinations thereof.

In an embodiment, the matrix includes a propylene homopolymer.

In an embodiment, the matrix 14 includes a propylene/α-olefin copolymer. Representative α-olefins include, but are not limited to, $C_4$-$C_{20}$ α-olefins or $C_4$-$C_{10}$ α-olefins. Representative α-olefins include 1-butene, 1-pentene, 1-hexene, 1-heptene and 1-octene.

In an embodiment, the matrix 14 includes a polymeric material selected from an ethylene/$C_3$-$C_{10}$ α-olefin copolymer, LDPE, HDPE, a propylene homopolymer and combinations thereof.

In an embodiment, the matrix 14 includes a polymeric material containing an ethylene/$C_3$-$C_{10}$ α-olefin copolymer and LDPE. The polymeric material contains from 1 wt % to 99 wt % of an ethylene/$C_3$-$C_{10}$ α-olefin copolymer and from 1 wt % to 99 wt % LDPE, based on the total amount of polymeric material. In a further embodiment, the polymeric material contains from 50 wt %, or 60 wt %, or 70 wt % to 80 wt %, or 85 wt %, or 90 wt %, or 95 wt %, or 99 wt % ethylene/$C_3$-$C_{10}$ α-olefin copolymer and from 1 wt %, or 5 wt %, or 10 wt %, or 15 wt %, or 20 wt % to 30 wt %, or 40 wt %, or 50 wt % LDPE, based on the total amount of polymeric material.

In an embodiment, the matrix 14 does not absorb liquid.

The matrix 14 may be formed from reciprocal layers, or as an integral and uniform polymeric material. In an embodiment, the microcapillary sheet 11 is a cast sheet made via cast extrusion or a molded sheet. In an embodiment, the microcapillary sheet 11 is shaped by mechanical or thermal processes. In another embodiment, the microcapillary sheet 11 is thermoformed, vacuum formed, and/or compression molded to obtain its shape.

The matrix may comprise two or more embodiments disclosed herein.

B. Plurality of Channels

As shown in FIGS. 1, 3, 3A and 5, the microcapillary sheet 11 includes a plurality of channels 15.

The plurality of channels 15 extend in parallel, or substantially parallel, through the matrix 14 and between opposing surfaces (13*a*, 13*b*) of the microcapillary sheet 11, as shown in FIGS. 2-3A. The term "parallel," as used herein, refers to channels extending in the same direction and never intersecting. FIGS. 3 and 3A depict parallel channels 15. The plurality of channels 15 are sandwiched between the opposing surfaces (13*a*, 13*b*) of the microcapillary sheet 11, as shown in FIGS. 3 and 3A. The channels 15 extend from the first end 12*a* of the microcapillary sheet to the second end 12*b* of the microcapillary sheet. Each channel 15 is formed from a wall 17 that extends around the perimeter of the channel, from a cross-sectional view, as shown in FIGS. 2-3A. The channel wall 17 is formed from the matrix 14.

Figure 4:
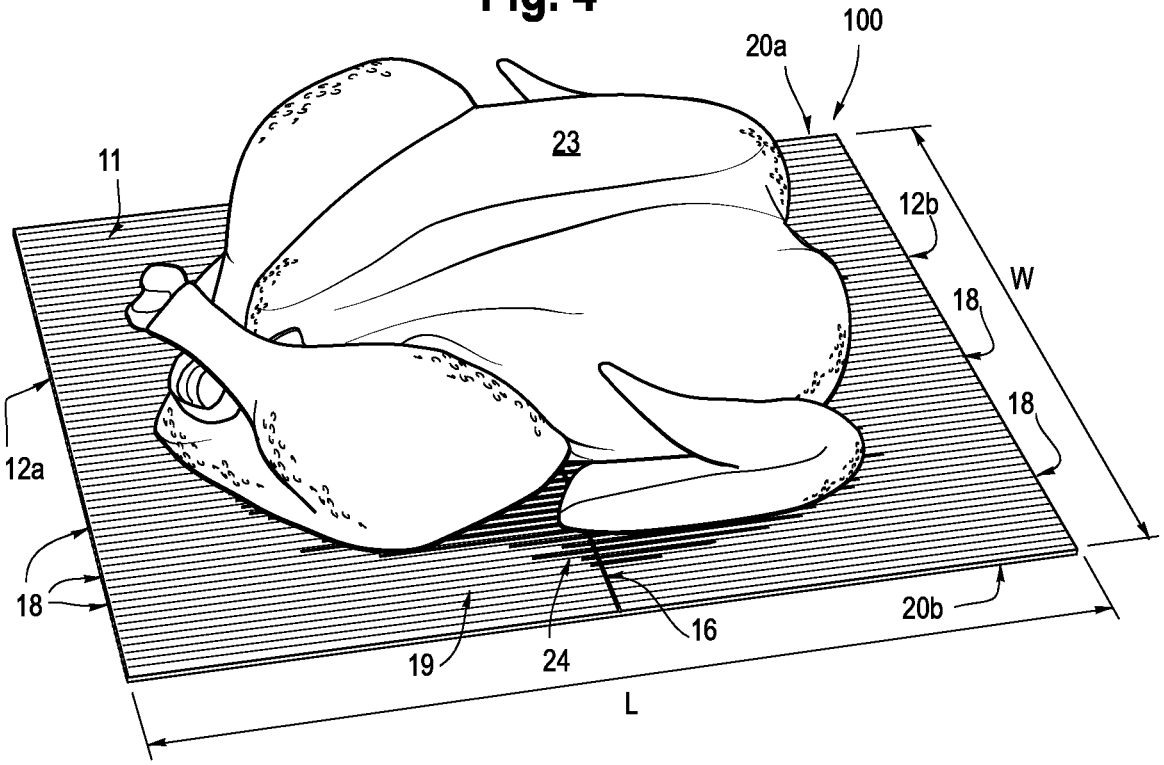
FIG. 4 is a perspective view of a food package with a microcapillary sheet and a food item in accordance with an embodiment of the present disclosure.
Figure 4A:
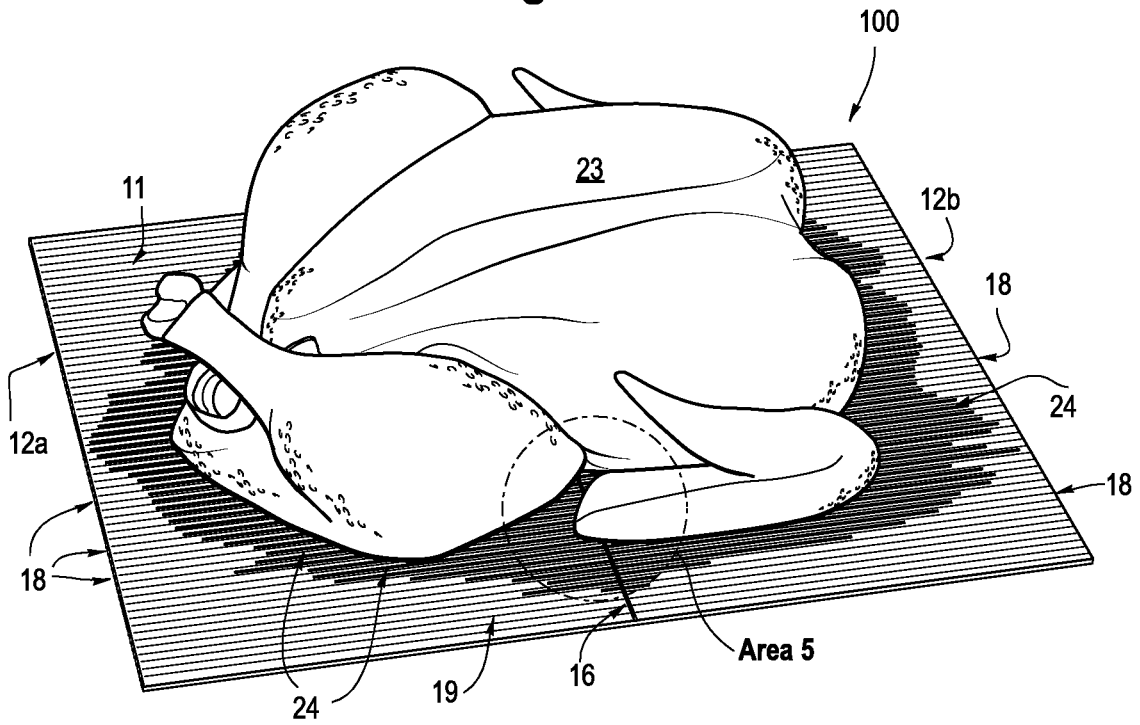
FIG. 4A is a perspective view of a food package with a microcapillary sheet and a food item in accordance with an embodiment of the present disclosure.

Each channel 15 has at least one exposed end 18, as shown in FIGS. 4 and 4A. In an embodiment, each channel 15 has an interior 25, as shown in FIGS. 2-2B. The exposed end 18 places the interior 25 of the channel 15 in fluid communication with ambient environment. In an embodiment, each channel 15 has two exposed ends 18, wherein one exposed end 18 is located at the first end 12*a* of the microcapillary sheet 11 and the other exposed end 18 is located at the second end 12*b* of the microcapillary sheet, as shown in FIGS. 4 and 4A.

Each channel 15 has a cross-sectional shape. Nonlimiting examples of suitable cross-sectional shapes for the channels 15 include oval, ovoid, circle, curvilinear, triangle, square, rectangle, star, diamond, and combinations thereof. FIGS. 3 and 3A depict channels 15 having a circle cross-sectional shape.

The channels 15 have a diameter, D, as shown in FIGS. 3 and 3A. The term "diameter," as used herein, is the longest axis of the channel 15, from a cross-sectional view. The diameter, D, (i.e., the longest axis) is typically the "width" of the channel 15 considering the microcapillary sheet 11 in a horizontal position. In an embodiment, the diameter, D, is from 300 micrometer (μm), or 350 μm, or 400 μm, or 500 μm, or 600 μm, or 700 μm, or 800 μm, or 900 μm to 1000 μm, or 1100 μm, or 1200 μm, or 1500 μm, or 2000 μm, or 2500 μm, or 3000 μm. In an embodiment, the diameter, D, is from 800 μm to 1500 μm.

The channels 15 have a short axis, X, as shown in FIGS. 3 and 3A. The short axis is the shortest axis of the channel 15 from the cross section point of view. The shortest axis is typically the "height" of the channel 15 considering the microcapillary sheet 11 in a horizontal position. In an embodiment, each channel 15 has a short axis, X, from 100 μm, 150 μm, or 200 μm, or 250 μm, or 300 μm, or 350 μm, or 400 μm, or 500 μm, or 600 μm, or 700 μm, or 800 μm, or 900 μm to 1000 μm, or 1100 μm, or 1200 μm, or 1500 μm, or 2000 μm, or 2500 μm, or 3000 μm.

The number of channels 15 may be varied as desired. In an embodiment, the microcapillary sheet 11 has at least 2 channels, or at least 10 channels, or at least 20 channels, or at least 30 channels. In an embodiment, the microcapillary sheet has from 2, or 3, or 5, or 10, or 15, or 20, or 25, or 30 to 40, or 50, or 70, or 80, or 100, or 150, or 200, or 250 channels.

A spacing, S, of matrix 14 is present between the channels 15, as shown in FIGS. 3 and 3A. In an embodiment, the spacing, S, is from 1 μm, or 5 μm, or 10 μm, or 25 μm, or 50 μm, or 100 μm to 120 μm, or 150 μm, or 200 μm, or 250 μm, or 300 μm, or 350 μm, or 400 μm, or 500 μm, or 1000 μm, or 2000 μm or 3000 μm.

In an embodiment, the microcapillary sheet 11 includes a plurality of channels 15 stacked on top of one another in layers and extending in parallel, or substantially parallel, through the matrix 14 and between opposing surfaces (13*a*, 13*b*) of the microcapillary sheet 11. The plurality of channels 15 stacked on top of one another in layers may be formed by coextrusion into a single microcapillary sheet 11, or from laminating together at least two layers of matrix 14 having a plurality of channels 15 into a single microcapillary sheet, or combinations thereof.

The plurality of channels may comprise two or more embodiments disclosed herein.

C. Perforation

As shown in FIGS. 1, 2-2B and 5, the microcapillary sheet 11 includes a perforation 16.

The perforation 16 extends from a surface (13*a*, 13*b*) of the microcapillary sheet 11 through a wall 17 of at least two channels 15. In an embodiment, the perforation 16 extends from surface 13*a* of the microcapillary sheet 11 through a portion of the matrix 14 and through a wall 17 of at least two channels 15 and does not extend to the opposing surface 13*b* of the microcapillary sheet. The perforation 16 places the interior 25 of the channel 15 in fluid communication with ambient environment.

The perforation 16 is continuous or discontinuous. A "continuous perforation" is a perforation that traverses at least two adjacent channels 15. FIG. 1 depicts a continuous perforation 16. A "discontinuous perforation" is a perforation that traverses at least two non-adjacent channels 15.

In an embodiment, the perforation 16 traverses at least two channels 15 and the spacing, S, of matrix 14 present between the channels 15, as shown in FIGS. 2, 2A, 2B and 5.

The perforation 16 has a shape from a sectional view. Nonlimiting examples of suitable shapes include a V-shape from a cross-sectional view, a rectangular shape from a cross-sectional view, an inverted V-shape from a cross-sectional view, a diagonal shape from a cross-sectional view, and combinations thereof. FIG. 2 shows a perforation 16 having a V-shape from a cross-sectional view. FIGS. 2A and 2B show perforations 16 having a rectangular shape from a cross-sectional view. Figured 5 and 6 show a perforation 16 having a rectangular shape from a cross-sectional view.

Figure 9:
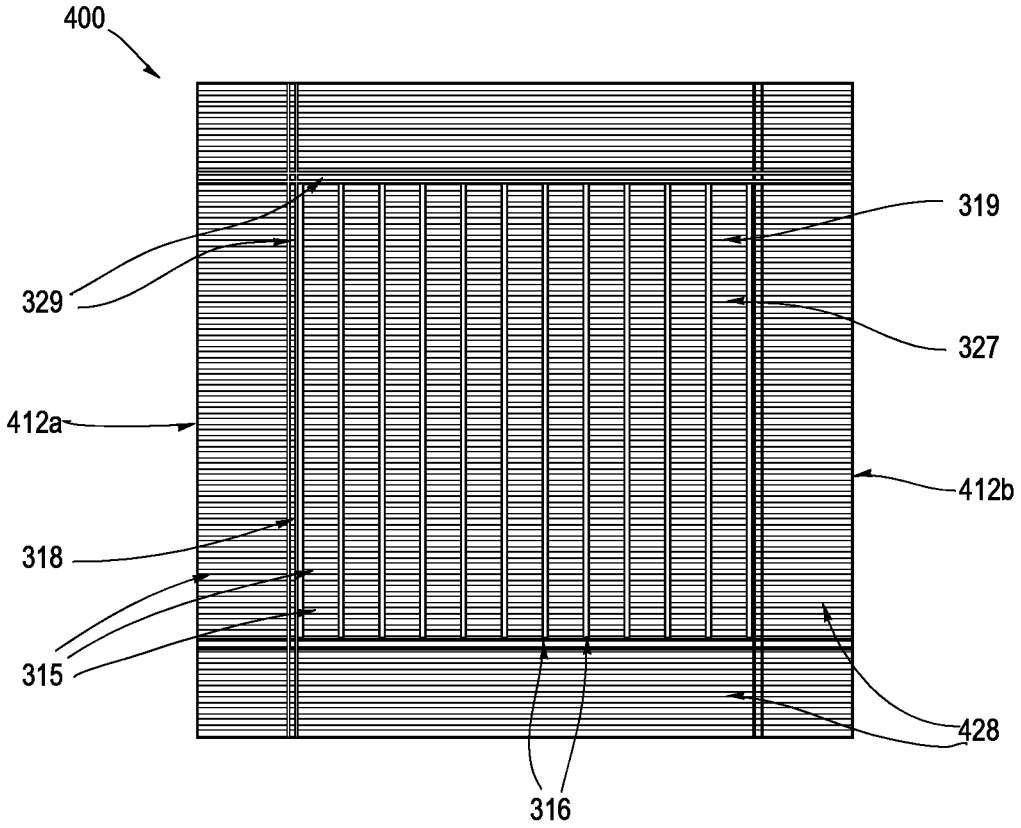
FIG. 9 is a top plan view of a pre-formed tray formed from a microcapillary sheet in accordance with another embodiment of the present disclosure.
Figure 10:
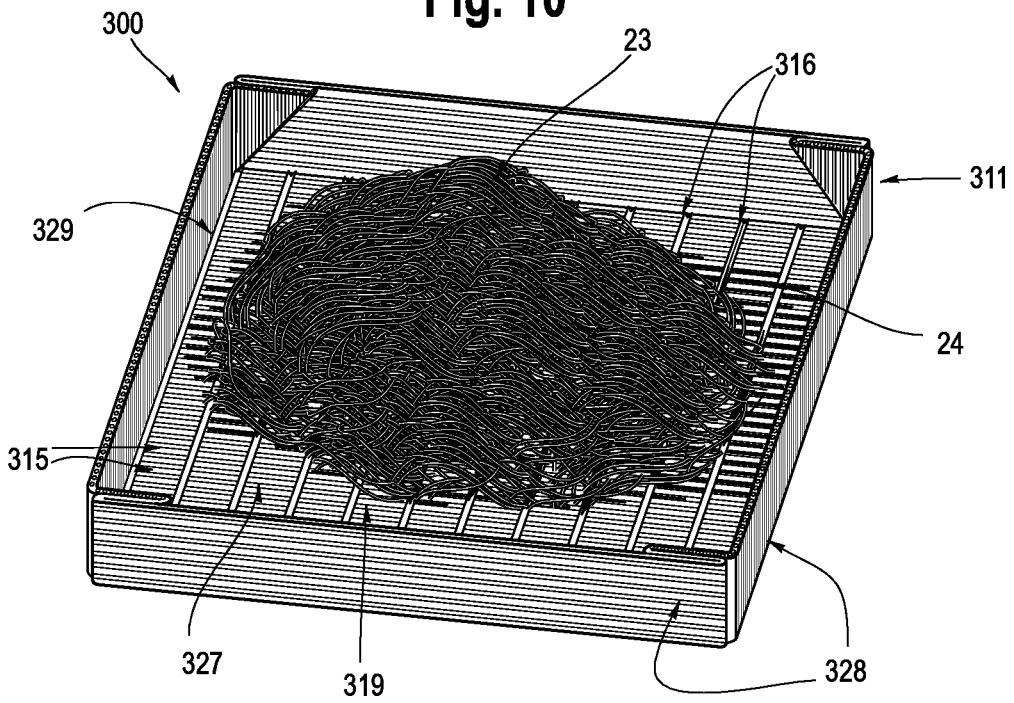
FIG. 10 is a perspective view of a food package with a tray formed from a microcapillary sheet in accordance with another embodiment of the present disclosure.

In an embodiment, the microcapillary sheet 11 includes a plurality of perforations 16, as shown in FIGS. 9 and 10. In an embodiment, the microcapillary sheet 11 includes at least 1 perforation 16. In an embodiment, the microcapillary sheet 11 includes from 1, or 2, or 3 to 4, or 5, or 6 to 7, or 8, or 9, or 10, or 11, or 15, or 20 perforations.

In an embodiment, the perforation 16 traverses at least 2 channels, or at least 3 channels, or at least 4 channels, or at least 5 channels, or at least 10 channels. In an embodiment, the perforation 16 traverses each channel 15 of the microcapillary sheet 11, as shown in FIG. 1.

The perforation 16 has a height, H, as shown in FIGS. 2-2B. In an embodiment, the perforation 16 has a height, H, from 200 μm, or 250 μm, or 300 μm, or 350 μm, or 400 μm, or 450 μm to 500 μm, or 600 μm, or 650 μm, or 700 μm, or 750 μm, or 1000 μm, or 1250 μm, or 1500 μm, or 1750 μm or 2000 μm. In a further embodiment, the height, H, is from 200 μm to 1000 μm.

In an embodiment, the microcapillary sheet 11 includes plurality of channels 15 stacked on top of one another in layers and the perforation 16 extends through a wall 17 of at least one channel in each layer of channels 15.

In an embodiment, the perforation 16 is produced by a mechanical tool or by a laser beam. In an embodiment, the perforation 16 is produced using a steel razor saw.

In an embodiment, the perforation 16 defines a scored surface 19, as shown in FIGS. 2-2B, 4 and 4A.

In an embodiment, the microcapillary sheet 11 includes at least two perforations 16, with at least one perforation 16 extending from each opposing surface (13*a*, 13*b*) such that the microcapillary sheet has two scored surfaces 19.

In an embodiment, the perforation 16 extends from a first side 20*a* to the opposing second side 20*b* of the microcapillary sheet 11. In an embodiment, the perforation 16 is a continuous perforation extending from a first side 20*a* to the opposing second side 20*b* of the microcapillary sheet 11, as shown in FIG. 1. In another embodiment, the perforation 16 is a discontinuous perforation extending from a first side 20*a* to the opposing second side 20*b* of the microcapillary sheet 11.

Bounded by no particular theory, it is believed that capillary action draws or wicks liquid 24 (i.e., liquid 24 from the food item 23) through the perforation 16 and into an interior 25 of the channels 15, as shown in FIGS. 5, 6, 7A and 7B. The term "capillary action" is the ability of a liquid to flow against gravity where liquid spontaneously rises in a narrow space such as between the hairs of a paint-brush, in a thin tube, in porous material such as paper, in some non-porous materials such as liquefied carbon fiber, or in a cell. Capillary action can cause liquids to flow against the force of gravity, sun or any electromagnetic field affecting fluid flow. Capillary action occurs because of inter-molecular attractive forces between the transporting liquid and surrounding surface having a different surface energy. For the case of a tube, if the diameter of the tube is sufficiently small, then the combination of surface energy (which is caused by cohesion within the liquid) and force of adhesion between the liquid and tube wall act to lift the liquid. The capillary force is inversely proportional to the capillary diameter and is proportional to both the surface tension of the liquid and the contact angle between the liquid 24 and the channel walls 17. The force is formed at the liquid-air interface inside the capillary (i.e., inside the channel interior 25).

The term "contact angle" is the angle formed by the intersection of the liquid-solid interface and liquid-vapor interface when a liquid drop is resting on a flat horizontal solid surface, the flat horizontal solid surface composed of the polymeric material of the matrix 14. The contact angle is geometrically acquired by applying a tangent line from the contact point along the liquid-vapor interface in the droplet profile. A contact angle less than 90° indicates that wetting of the surface is favorable, and the liquid 24 will spread over a large area on the surface. A contact angle greater than or equal to 90° indicates that wetting of the surface is unfavorable so the liquid 24 will minimize its contact with the surface to form a compact liquid droplet.

The contact angle is measured in accordance with ASTM D5946, wherein the substrate surface is the polymeric material of the matrix 14.

In an embodiment, the channels 15 and/or the microcapillary sheet 11 exhibit a contact angle from 0°, or greater than 0° to less than 90°. In a further embodiment, the channels 15 and/or the microcapillary sheet 11 exhibit a contact angle from 65°, or 68°, or 70°, or 71°, or 75° to 77°, or 80°, or 84°, or 86°, or 88°, or 89°.

The channels 15, the channel interior 25, and/or the microcapillary sheet 11 may be further modified by surface treatment to obtain a contact angle from 0° to 90° (or any subrange as previously disclosed). Nonlimiting examples of suitable surface treatment included plasma surface treatment, chemical grafting surface treatment, and combinations thereof. In an embodiment, the channels 15, the channel interior 25, and/or the microcapillary sheet 11 are treated in a dielectric barrier discharge atmospheric or low pressure plasma including aerosoled functional molecules such as amines, hydroxyls, allyls, acrylics, fluorines, silicones, and the like to modify surface energy. The surface treatment may be for a period in the range of from 1 second to one hour, for example, from 1 to 60 seconds.

Figure 6:
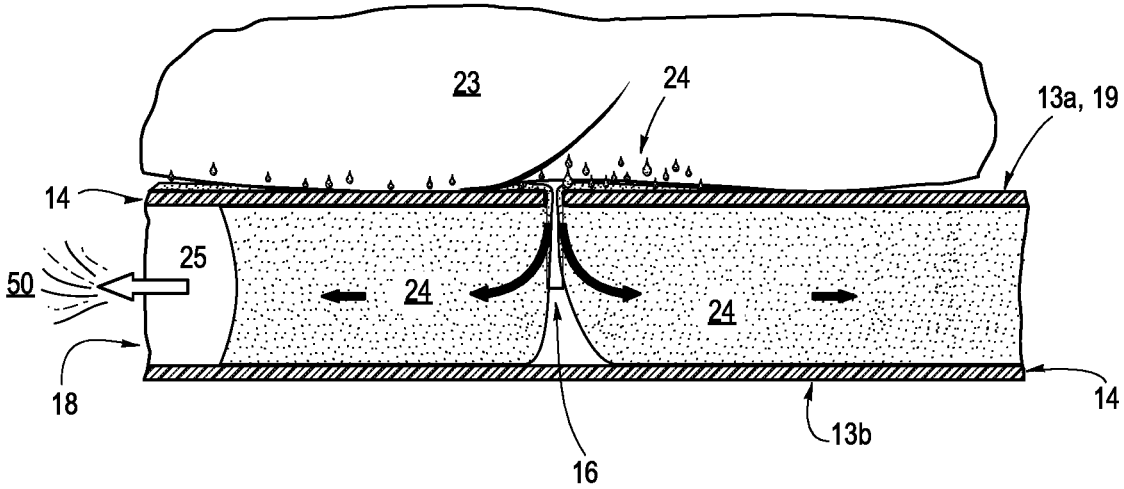
FIG. 6 is a cross-sectional view of a microcapillary sheet and a food item taken along line 6-6 of FIG. 5 in accordance with an embodiment of the present disclosure.
Figure 7:
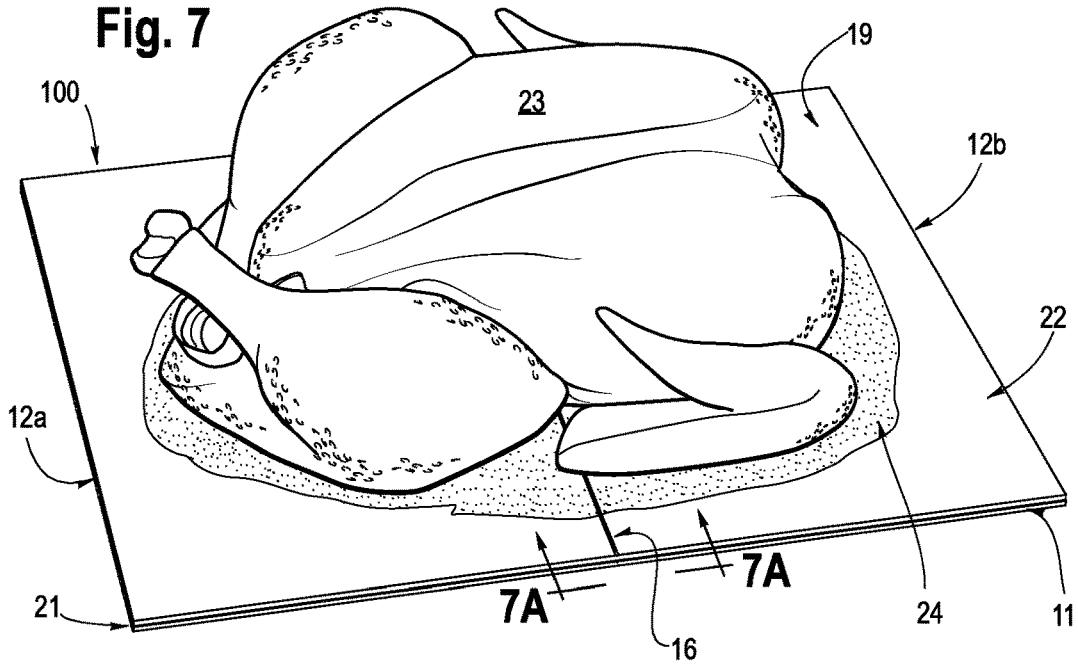
FIG. 7 is a perspective view of a food package with a microcapillary sheet having a coating and a food item in accordance with another embodiment of the present disclosure.
Figure 7A:
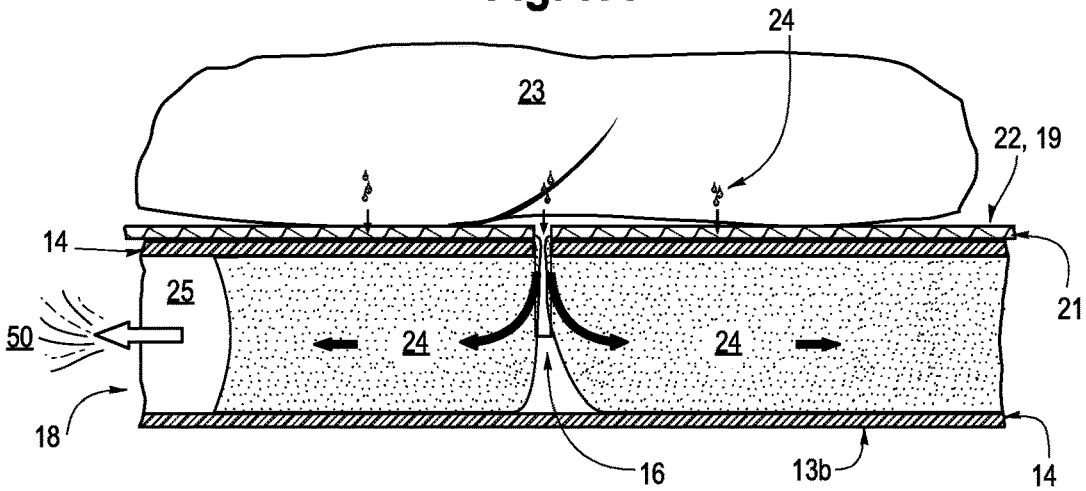
FIG. 7A is a cross-sectional view of the coated microcapillary sheet and food item taken along line 7A-7A of FIG. 7.
Figure 7B:
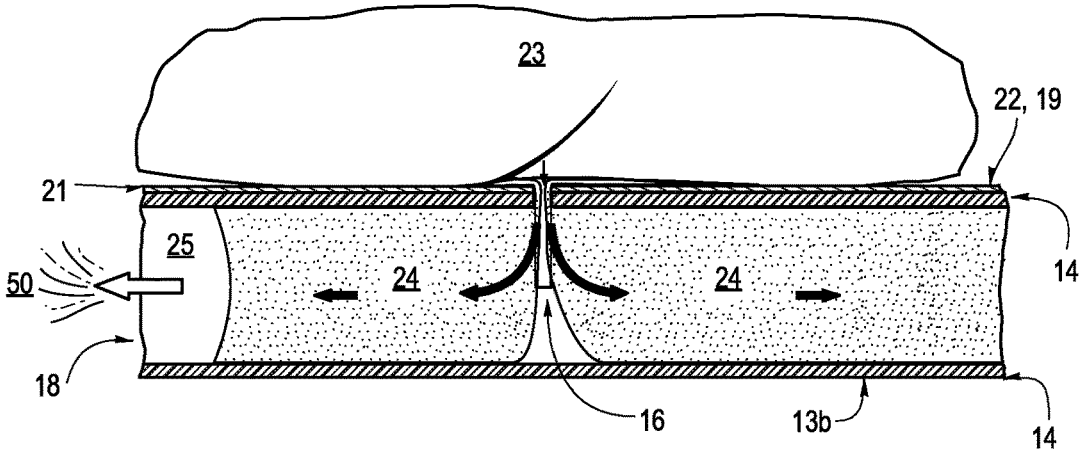
FIG. 7B is a cross-sectional view of the coated microcapillary sheet and food item taken along line 7A-7A of FIG. 7 in accordance with another embodiment of the present disclosure.

With contact angle from 0° to 90° (or any subrange previously disclosed), capillary action draws liquid 24 through the perforation 16 and into an interior 25 of the channels 15. The channels 15 have at least one exposed end 18. As liquid 24 is drawn in through the perforation 16, air 50 moves out of the channel through the exposed end 18, as shown in FIGS. 6, 7A and 7B. Capillary action wicks the liquid 24 through the perforation 16 and into the channel interior 25. If the perforation 16 is on the top surface 13*a* of the microcapillary sheet 11, then any liquid 24 in and above the perforation 16 will provide a small gravity force to aid in drawing the liquid 24 into the channels 15. When there is no longer any liquid 24 available to feed a channel 15, there will be two liquid-air interfaces inside the channel with opposing capillary forces, which will prevent the liquid 24 from moving further into the channel 15 allowing the liquid 24 to be retained without flowing out from the exposed ends 18. Capillary action allows liquid 24 to be drawn into the perforation 16 and toward the exposed end 18.

Figure 5:
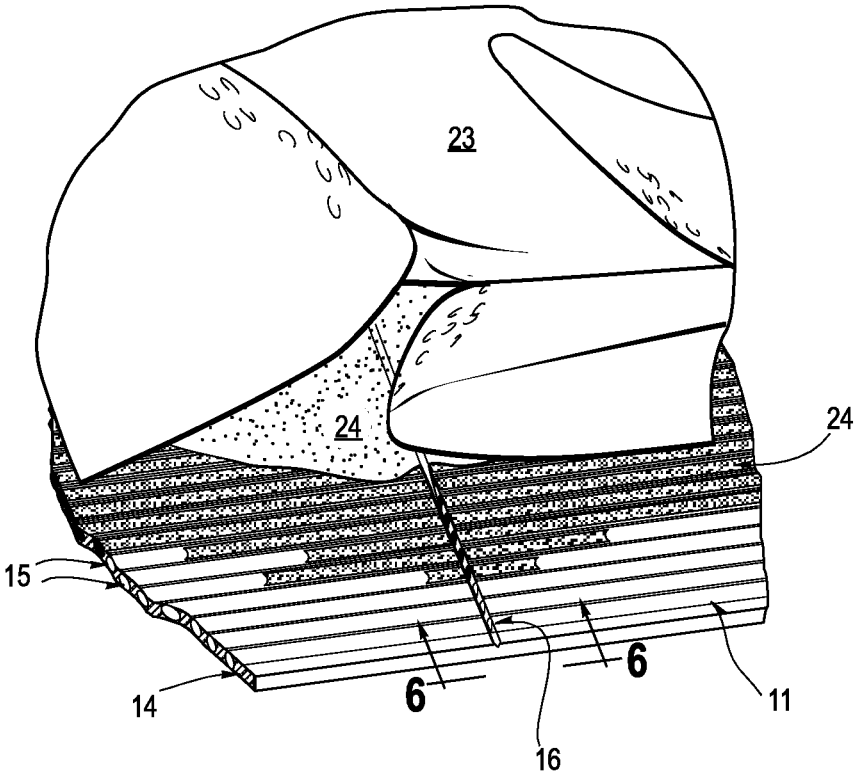
FIG. 5 is an enlarged view of area 5 of FIG. 4A in accordance with an embodiment of the present disclosure.

FIGS. 4 and 4A depict capillary action pulling liquid 24 through the perforation 16 into the interior 25 of a plurality of channels 15 and toward the channels' exposed ends 18. FIG. 5 depicts an expanded view of liquid 24 being drawn through the perforation 16 into the interior 25 of a plurality of channels 15.

After the liquid 24 is drawn through the perforation 16 and into the interior 25 of the channels 15 by capillary action, the liquid 24 is in contact with the matrix 14 of the microcapillary sheet 11 at the walls 17 of the channels 15, as shown in FIGS. 6, 7A and 7B.

The perforation may comprise two or more embodiments disclosed herein.

D. Antimicrobial Material

In an embodiment, the matrix 14 further includes an antimicrobial material dispersed through the matrix. An "antimicrobial material" is an agent that kills microorganisms or inhibits microorganism growth. Microorganism growth is efficiently controlled by an antimicrobial material present in the matrix 14. Bounded by no particular theory, it is believed that the high internal surface area of the channels 15 enhances the effect of an antimicrobial material dispersed through the matrix 14.

In an embodiment, the antimicrobial material is a biocide. Nonlimiting examples of suitable biocides are silver- and zinc-based biocides, quaternary ammonium salts, amino acid derivatives, lauric arginate, organic acids, peptides, bacteriophages, and combinations thereof. A nonlimiting example of a suitable zinc-based biocide is bis(2-pyridylthio)zinc 1,1'-dioxide ("ZPT"). Commercially available silver-based biocides include but are not limited to NANOXClean™ antimicrobials such as NANOXClean™ NNXC AA 15 PE, available from NANOXClean.

In an embodiment, the matrix 14 includes from 0 wt %, or 0.1 wt %, or 0.5 wt %, or 1.0 wt % to 2.0 wt %, or 3.0 wt %, or 4.0 wt %, or 5 wt %, or 6 wt % antimicrobial material, and from 94 wt %, or 95 wt %, or 96 wt %, or 97 wt %, or 98 wt % to 99 wt %, or 99.5 wt %, or 99.9 wt %, or 100 wt % polymeric material, based on the total weight of the matrix 14.

The antimicrobial material may comprise two or more embodiments disclosed herein.

Figure 8:
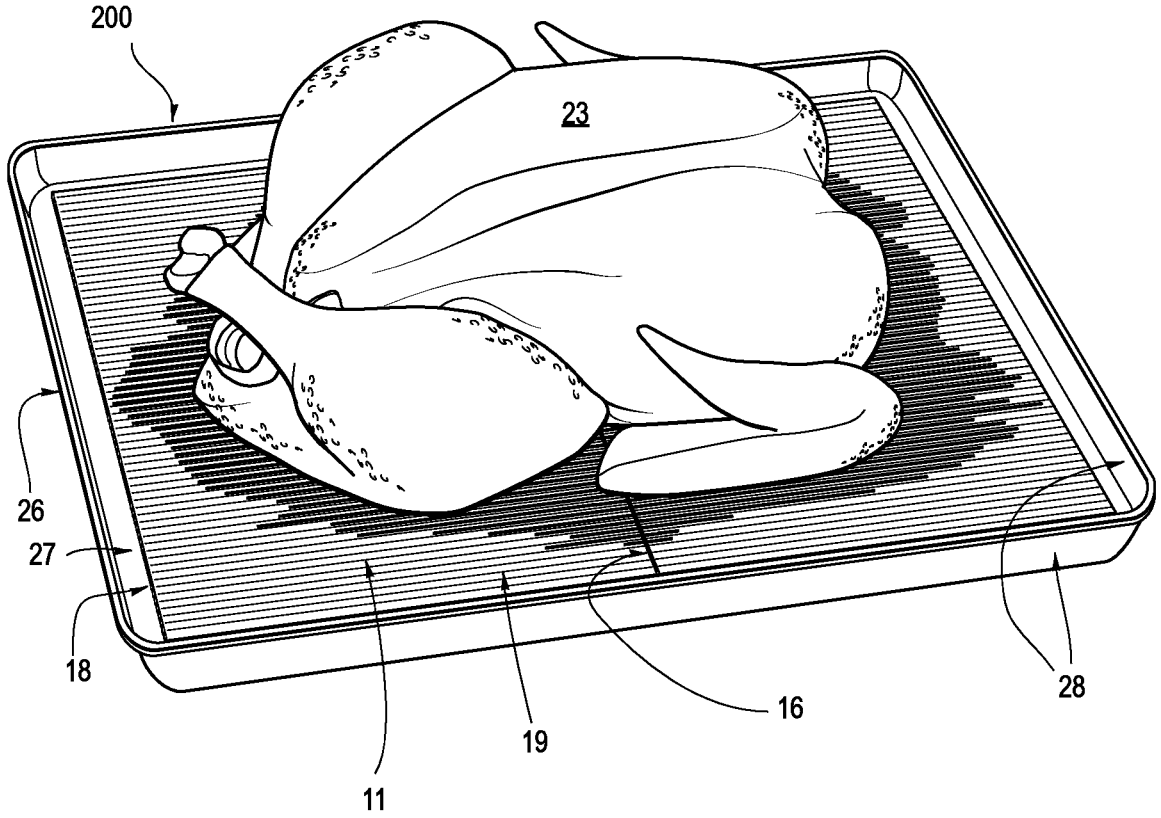
FIG. 8 is a perspective view of a food package with a microcapillary sheet, a food item and a tray in accordance with another embodiment of the present disclosure.

In an embodiment, the microcapillary sheet 11 has a polygonal shape. A "polygonal shape" is a closed-plane figure bounded by at least three sides. Nonlimiting examples of suitable polygonal shapes include triangle, square, rectangle, and octagon. In an embodiment, the microcapillary sheet 11 has a rectangular shape, as shown in FIGS. 1 and 8.

In an embodiment, the microcapillary sheet 11 is in the shape of a circle, an oval, or an ovoid.

The microcapillary sheet 11 has a thickness, T, as shown in FIGS. 2-3A. In an embodiment, the thickness, T, is from 500 μm, or 600 μm, or 700 μm, or 800 μm, or 900 μm to 1000 μm, or 1200 μm, or 1300 μm, or 1400 μm, or 1500 μm, or 2000 μm, or 2500 μm, or 3000 μm, or 3500 μm or 4000 μm. In a further embodiment, the thickness, T, is from 700 μm to 1500 μm. In a further embodiment, the thickness, T, is from 500 μm to less than 1000 μm, or less than 2000 μm, or less than 3000 μm, or less than 4000 μm.

In an embodiment, the short axis, X, of each channel 15 is from 10%, or 15%, or 20%, or 30%, or 40%, or 45%, or 50% to 60%, or 70%, or 75%, or or 80%, or 90%, or 95% of the thickness, T.

In an embodiment, the perforation 16 has a height, H, equal to at least 15%, or at least 25% of the thickness, T, of the microcapillary sheet 11. The height, H, of the perforation 16 is less than the thickness, T, of the microcapillary sheet 11. In an embodiment, the perforation 16 has a height, H, from 15%, or 20%, or 25%, or 30%, or 35%, or 40%, or 50% to 55%, or 60%, or 65 T, or 70%, or 75%, or 80%, or 90%, or 95%, or 99% of the thickness, T, of the microcapillary sheet 11. In a further embodiment, the perforation 16 has a height, H, that is 50% of the thickness, T, of the microcapillary sheet 11.

The microcapillary sheet 11 has a width, W, as shown in FIG. 4. The width, W, of the microcapillary sheet 11 is the distance between the first side 20*a* and the opposing side 20*b* of the microcapillary sheet 11. In an embodiment, the microcapillary sheet 11 has a width, W, from 4.0 centimeter (cm), or 5.0 cm, or 6.0 cm, or 7.0 cm, or 8.0 cm, or 9.0 cm, or 10.0 cm to 11.0 cm, or 15.0 cm, or 18.0 cm, or 20.0 cm, or 25.0 cm, or 30.0 cm, or 40.0 cm, or 50.0 cm, or 60.0 cm, or 65.0 cm, or 70.0 cm, or 80.0 cm, or 90.0 cm, or 100.0 cm, or 150.0 cm.

The microcapillary sheet 11 has a length, L, as shown in FIG. 4. The length, L, of the microcapillary sheet 11 is the distance between the first end 12*a* and the second end 12*b* of the microcapillary sheet 11. In an embodiment, the microcapillary sheet 11 has a length, L, from 4.0 centimeter (cm), or 5.0 cm, or 6.0 cm, or 7.0 cm, or 8.0 cm, or 9.0 cm, or 10.0 cm to 11.0 cm, or 15.0 cm, or 18.0 cm, or 20.0 cm, or 25.0 cm, or 30.0 cm, or 40.0 cm, or 50.0 cm, or 60.0 cm, or 70.0 cm, or 80.0 cm, or 90.0 cm, or 100.0 cm, or 150.0 cm.

In an embodiment, the microcapillary sheet 11 includes at least 5 percent by volume of the matrix 14, based on the total volume of the microcapillary sheet 11. In an embodiment, the microcapillary sheet 11 contains from 5 percent by volume (vol. %), or 10 vol. %, or 20 vol. %, or 30 vol. %, or 40 vol. %, or 50 vol. %, or 60 vol. % to 65 vol. %, or 70 vol. %, or 80 vol. % of the matrix 14, based on the total volume of the microcapillary sheet 11. In an embodiment, the microcapillary sheet contains from 50 vol. % to 80 vol. % of the matrix 14, based on the total volume of the microcapillary sheet 11.

In an embodiment, the microcapillary sheet 11 includes at least 20 vol. % of channels 15, based on the total volume of the microcapillary sheet 11. In an embodiment, the microcapillary sheet 11 contains from 20 vol. %, or 25 vol. %, or 30 vol. % to 35 vol. %, or 40 vol. %, or 50 vol. %, or 60 vol. %, or 70 vol. %, or 80 vol. %, or 90 vol. %, or 95 vol. % of channels 15, based on the total volume of the microcapillary sheet 11. In an embodiment, the microcapillary sheet contains from 20 vol. % to 50 vol. % of the channels 15, based on the total volume of the microcapillary sheet 11.

In an embodiment, the channels 15 have a diameter, D, from 300 μm to 3000 μm and the microcapillary sheet 11 has a spacing, S, from 1 μm to 3000 μm, a thickness, T, from 500 μm to 4000 μm, a width, W, from 4.0 cm to 150.0 cm and a length, L, from 4.0 cm to 150.0 cm. In an embodiment, the microcapillary sheet 11 includes at least 20 vol. % of channels 15, based on the total volume of the microcapillary sheet 11. In an embodiment, the microcapillary sheet contains from 5 vol. % to 80 vol. % of the matrix 14, based on the total volume of the microcapillary sheet 11.

In an embodiment, the microcapillary sheet 11 is colored or tinted. In an embodiment, the matrix 14 includes a pigment. A nonlimiting example of a suitable pigment is titanium dioxide, which provides a white color to the matrix 14. In an embodiment, one or both of the opposing surfaces (13*a*, 13*b*) of the microcapillary sheet contain a graphic.

E. Optional Coating or Film Layer

In an embodiment, the microcapillary sheet 11 optionally includes a coating or film layer 21 on at least a portion of one of the opposing surfaces (13*a*, 13*b*) of the microcapillary sheet 11, on at least a portion of the channel walls 17, and combinations thereof. FIGS. 7, 7A and 7B depict various views of a microcapillary sheet with a coating or film layer 21 in contact with an opposing surface 13*a* of the microcapillary sheet 11.

In an embodiment, the coating or film layer 21 is an antimicrobial coating or film layer, an anti-slip coating or film layer, a decorative coating or film layer, an absorbent coating or film layer, a barrier coating or film layer, and combinations thereof.

In an embodiment, the microcapillary sheet 11 includes a coating or film layer 21. The coating or film layer 21 contains an antimicrobial material. The antimicrobial material may be any antimicrobial material as previously described herein. The microcapillary sheet 11 includes a coating or film layer 21 containing an antimicrobial material on at least a portion of one of the opposing surfaces (13*a*, 13*b*) of the microcapillary sheet 11.

In an embodiment, the microcapillary sheet 11 includes a coating or film layer 21 that does not contain an antimicrobial material. The matrix 14 of the microcapillary sheet 11 contains an antimicrobial material, and the microcapillary sheet 11 has a coating or film layer 21 that does not contain an antimicrobial material.

In an embodiment, the coating or film layer 21 contains one or more polymeric materials. The polymeric material may be any polymeric material previously described herein. In an embodiment, the coating or film layer 21 includes the same polymeric material as the matrix 14.

In an embodiment, the coating or film layer 21 includes a different polymeric material than the matrix 14. In an embodiment, the coating or film layer 21 includes a polymeric material selected from EVOH, polyvinyl alcohol (PVOH), ethylene-acrylic polymers, maleic-anhydride grafted polyethylene, and combinations thereof.

In an embodiment, the coating or film layer 21 is applied via extrusion coating, gravure coating, slot-die coating, extrusion lamination, or adhesive lamination.

In an embodiment, the coating or film layer 21 extends from the first end 12*a* to the second end 12*b* of the microcapillary sheet, as shown in FIG. 7. In an embodiment, the coating or film layer 21 extends the width, W, of the microcapillary sheet, as shown in FIG. 7.

In an embodiment, the coating or film layer 21 is on the scored surface 19, and the perforation 16 extends through the surface 22 of the coating or film layer 21, through a portion of the matrix 14 and through a wall 17 of each channel 15 that the perforation 16 traverses, as shown in FIGS. 7A and 7B. The perforation 16 places the interior 25 of the channel 15 in fluid communication with ambient environment.

In an embodiment, a tie layer is present between the opposing surface (13*a*, 13*b*) of the microcapillary sheet 11 and the coating or film layer 21. In an embodiment, the tie layer is in contact with an opposing surface (13*a*, 13*b*) and the coating or film layer 21. In an embodiment, the tie layer includes a maleic anhydride grafted polyethylene, a polypropylene, an ethylene vinyl acetate ("EVA") copolymer, and combinations thereof.

In an embodiment, the coating or film layer 21 is in contact with a tie layer and the tie layer is in contact with the scored surface 19. The perforation 16 extends through the coating or film layer 21 and tie layer to the scored surface 19, through a portion of the matrix 14 and through a wall of each channel 15 that the perforation 16 traverses. The perforation 16 places the channel 15 interior 25 in fluid communication with ambient environment.

In an embodiment, the microcapillary sheet 11 includes a coating or film layer 21 on at least a portion of the channel walls 17. A coating 21 may be applied to the channel walls by drawing a liquid coating through the channels 15 via a vacuum on one end (12*a*, 12*b*) of the microcapillary sheet 11, or by using capillary action to wick a liquid coating through the perforation 16 into the channels 15 and then using air pressure or vacuum pressure to remove excess coating, and then drying the coating. In an embodiment, the microcapillary sheet 11 includes a coating or film layer 21 on at least a portion of the channel walls 17 and the coating or film layer 21 includes an antimicrobial material.

The microcapillary sheet may comprise two or more embodiments disclosed herein.

2. Food Item

FIGS. 1, 4, 4A, 5-8 and 10 depict various views of a food item 23. The food item has liquid 24 that drains or flows from the food item 23 over time during storage, as shown in FIGS. 5, 6, 7 and 7A. After flowing from the food item 23, the liquid 24 accumulates in the food package 100, as shown in FIGS. 5 and 7.

In an embodiment, the food item 23 is a meat item, a poultry item, a fish item, a shellfish item, a vegetable item, a fruit item, or any derivative thereof, such as pate or reconstituted slices. Nonlimiting examples of suitable meat items include beef, pork, lamb, and goat. In an embodiment, the food item 23 is ground beef, as shown in FIG. 10. Nonlimiting examples of suitable poultry items include chicken, turkey, and duck. In an embodiment, the food item 23 is a chicken, as shown in FIGS. 1, 4, 4A, 5, 7 and 8. Nonlimiting examples of suitable fish items include tuna, salmon, pollock, catfish, swordfish, tilapia, and cod. Nonlimiting examples of suitable shellfish items include shrimp, crab, lobster, clams, mussels, oysters, and scallops. Nonlimiting examples of suitable fruit items include cucumbers, tomatoes, blueberries, peppers and tomatoes. Nonlimiting examples of suitable vegetable items include celery, lettuce, cauliflower, broccoli and carrots.

In an embodiment, the food item 23 has liquid 24 that includes water, microorganisms, proteins, fats, blood, soluble and insoluble food particles, and combinations thereof. Over time, microorganism growth in liquid 24 can degrade the food item 23. An advantage of the present disclosure is that capillary action draws liquid 24 containing microorganisms away from the food item 23. Additionally, the matrix 14, and/or an optional a coating or film layer 21 may contain an antimicrobial material that kills microorganisms or inhibits microbial growth.

In an embodiment, all, or substantially all, of the liquid 24 drained from the food item 23 during storage is retained in the microcapillary sheet 11. In an embodiment, from 70 vol. %, or 75 vol. %, or 80 vol. %, or 85 vol. %, or 90 vol. %, or 95 vol. % to 96 vol. %, or 97 vol. %, or 98 vol. %, or 99 vol. %, or 100 vol. % of the liquid 24 drained from the food item 23 during storage is retained in the microcapillary sheet 11.

In an embodiment, the total volume of the channels 15 in the microcapillary sheet 11 is sufficient to retain all liquid 24, or substantially all liquid 24, drained from a food item 23.

In an embodiment, the food item 23 is in contact with the scored surface 19 of the microcapillary sheet 11, as shown in FIGS. 4-6 and 10. Liquid 24 drained from the food item 23 passes through the perforation 16 of the microcapillary sheet 11 and into an interior 25 of the channels 15 and the liquid 24 is in contact with the matrix 14, as shown in FIGS. 5 and 6.

In an embodiment, the food item 23 is in contact with an opposing surface (13*a*, 13*b*) of the microcapillary sheet 11 that is not a scored surface 19.

In an embodiment, the microcapillary sheet 11 includes a coating or film layer 21 on at least one of the opposing surfaces (13*a*, 13*b*) and the food item 23 is in contact with the coating or film layer surface 22, as shown in FIGS. 7-7B. The food item 23 is in contact with the coating or film layer surface 22 and the coating or film layer 21 contains an antimicrobial material. In an embodiment, the matrix 14 and the coating or film layer 21 contain an antimicrobial material.

In an embodiment, the food item 23 is in contact with a coating or film layer 21 such that the food item 23 is not in contact with the matrix 14, as shown in FIGS. 7A and 7B. In a further embodiment, the food item 23 is in contact with a coating or film layer 21 such that the food item 23 is not in contact with the matrix 14, and an antimicrobial material is dispersed in the matrix 14. Dispersing an antimicrobial material in the matrix 14 of a microcapillary sheet 11 with a coating or film layer 21 such that a food item 23 is not in contact with the matrix 14 advantageously allows for the inclusion of antimicrobial material that typically cannot be used inside of absorbent packages or absorbent pads due to food contact regulations.

The food item may comprise two or more embodiments disclosed herein.

3. Tray

FIG. 8 depicts a food package 200 with a microcapillary sheet 11, a food item 23, and a tray 26. The microcapillary sheet 11 may be any microcapillary sheet 11 previously described herein. The food item 23 may be any food item 23 previously described herein.

The tray 26 has a base 27 and a plurality of walls 28 extending upward from the base 27, as shown in FIG. 8.

The tray 26 can be made from a polymeric material, a metal, a metal alloy, a glass and combinations thereof. The polymeric material may be any polymeric material previously disclosed. Nonlimiting examples of suitable polymeric materials include polystyrene, polypropylene, and combinations thereof. In an embodiment, the tray 26 includes an expanded polymeric material. In a further embodiment, the tray 26 includes an expanded polystyrene. A nonlimiting example of a suitable metal is aluminum. A nonlimiting example of a suitable metal alloy is stainless steel.

In an embodiment, the base 27 and the walls 28 of the tray 26 are formed from an integral polymeric material.

In an embodiment, the base 27 of the tray 26 has a shape. The shape may be any shape previously disclosed herein. In an embodiment, the base 27 of the tray 26 has a rectangular shape, as shown in FIG. 8.

The tray 26 has at least two walls 28, or at least three walls, or at least four walls. In an embodiment, the tray 26 has four walls 28 extending upward from the base 27, as shown in FIGS. 8 and 10. In an embodiment, each wall 28 is joined to the base 27. In a further embodiment, each wall 28 is joined to the base 27 and two other walls 28, as shown in FIG. 8.

In an embodiment, the tray 26 has a lid. In an embodiment, the lid is joined to one of the walls 28. In a further embodiment, the lid has a lid base and a plurality of lid walls extending downward from the lid base. In a further embodiment, a lid wall is joined to one of the walls 28 extending upward from the tray base 27.

In an embodiment, the food package 200 includes a microcapillary sheet 11 located on the base 27 of a tray 26, as shown in FIG. 8. In a further embodiment, the microcapillary sheet 11 is located between and in contact with a food item 23 and the base 27 of a tray 26, as shown in FIG. 8.

In an embodiment, the scored surface 19 of the microcapillary sheet 11 is in contact with a food item 23, and the opposing surface 13*b* of the microcapillary sheet 11 is in contact with the base 27 of the tray 26, as shown in FIG. 8. In another embodiment, the scored surface 19 of the microcapillary sheet 11 is in contact with the base 27 of the tray 26, and the opposing surface 13*b* of the microcapillary sheet 11 is in contact with a food item 23.

FIG. 10 depicts a food package 300 with a food item 23 and a tray 311 formed from a microcapillary sheet. The tray 311 may include any microcapillary sheet previously disclosed herein. The tray 311 includes a base 327 and a plurality of walls 328 extending upward from the base 327, as shown in FIG. 10. The base 327 includes a perforation 316 traversing at least two channels 315 of a plurality of channels 315. A trough 329 extends along a perimeter of the base 327. In a further embodiment, the walls 328 extend upward from the base 327 along the trough 329, as shown in FIG. 10. The base 327 has a scored surface 319. In an embodiment, the scored surface 319 is in contact with a food item 23.

FIG. 9 depicts a tray pre-form 400 formed from a microcapillary sheet. The tray pre-form 400 is assembled to produce the tray 311.

The tray pre-form 400 has a first end 412*a* and a second end 412*b*. The tray pre-form 400 includes a plurality of channels 315. A trough 329 defines a perimeter of a tray base 327. The base 327 includes a perforation 316. A plurality of pre-form walls 428 are joined to the base 327 at the trough 329, as shown in FIG. 9. The pre-form walls 428 may or may not be joined to one another.

Each channel 315 has at least one exposed end 318 at the trough 329.

In an embodiment, the base 327 and the walls 328 of the tray pre-form 400 are formed from an integral microcapillary sheet, as shown in FIG. 9.

In an embodiment, the tray 311 formed from a microcapillary sheet is formed via thermoforming or compression molding. The tray 311 formed from a microcapillary sheet formed via thermoforming may be prepared with a draw ratio from 1.1 to 2.0, or 3.0.

The tray pre-form may comprise two or more embodiments disclosed herein.

The tray may comprise two or more embodiments disclosed herein.

In a further embodiment, the food package (100, 200, 300) is wrapped with a film such as a barrier layer. Non-limiting examples of suitable materials for a barrier layer include copolymers of vinylidene chloride and methyl acrylate, methyl methacrylate or vinyl chloride (e.g., SARAN™ resins available from The Dow Chemical Company); ethylene-based polymers (such as polyethylene homopolymer); EVOH; PVC; and metal foil (such as aluminum foil). In an embodiment, the food package (100, 200, 300) is wrapped in polyvinylidene chloride (a SARAN™ film).

In an embodiment, the food package (100, 200, 300) excludes an absorbent pad.

The disclosed microcapillary sheet 11 does not exhibit problems with tearing or adhesion to food items 23 that are commonly associated with absorbent pads. Moreover, the microcapillary sheet 11 provides for cleaner and safer disposal than traditional absorbent pads.

While an advantage of the present disclosure is the provision of a food package (100, 200, 300) that excludes an absorbent pad, in an embodiment, the food package (100, 200, 300) may optionally include an absorbent pad. In an embodiment, the food package (100, 200, 300) includes an absorbent pad including cellulose pulp, super-absorbent polyacrylates and combinations thereof, encased in a non-woven textile wrapping bag. In an embodiment, the absorbent pad is in contact with the base 27 of the tray 26 and the microcapillary sheet 11. In an embodiment, the absorbent pad is in contact with the food item 23 and the microcapillary sheet 11. In a further embodiment, the absorbent pad is in contact with the food item 23 and the tray formed from a microcapillary sheet 311.

The food package may comprise two or more embodiments disclosed herein.

Test Methods

Density is measured in accordance with ASTM D792. The result is recorded in grams (g) per cubic centimeter (g/cc or g/cm$^3$).

Melt index (MI) is measured in accordance with ASTM D 1238, Condition 190° C./2.16 kg (g/10 minutes).

$T_m$ or "melting point" as used herein (also referred to as a melting peak in reference to the shape of the plotted DSC curve) is typically measured by the DSC (Differential Scanning calorimetry) technique for measuring the melting points or peaks of polyolefins, as described in U.S. Pat. No. 5,783,638. It should be noted that many blends comprising two or more polyolefins will have more than one melting point or peak, many individual polyolefins will comprise only one melting point or peak.

The percent by volume of channels, based on the total volume of the microcapillary sheet, is calculated by weighing (i) the microcapillary sheet and (ii) a solid sheet of the same polymeric material as the microcapillary sheet matrix with the same dimensions as the microcapillary sheet. The difference in mass between the two weighed sheets, divided by the density of the polymeric material, equals the vol. % of the channels, based on the total volume of the microcapillary sheet.

By way of example, and not limitation, examples of the present disclosure are provided.

EXAMPLES

1. Materials

The materials used to produce microcapillary sheets are provided in Table 1 below.

TABLE 1

Starting materials for microcapillary sheet

| Component | Specification | Source |
|---|---|---|
| ELITE ™ 5100G | ethylene/1-octene copolymer<br>density = 0.920 g/cc<br>melt index (190° C./2.16 kg) = 0.85 g/10 min<br>melting point = 123° C. | The Dow Chemical Company |
| LDPE 501I | low density polyethylene<br>density = 0.922 g/cc<br>melt index (190° C./2.16 kg) = 1.9 g/10 min<br>melting point = 111° C. | The Dow Chemical Company |

1. Microcapillary Sheets

A blend of 80 wt % ELITE™ 5100G and 20 wt % LDPE 501I is prepared by tumble mixing.

Microcapillary sheets 11 are fabricated on a film cast line having a 2.5 inch (63.5 mm) Killion single-screw extruder, a transfer line to transport the polymer melt, a 24 inch (610 mm) wide microcapillary die with 532 microcapillary pins (having an outside diameter of 0.030 inches (0.76 mm), an inner diameter of 0.014 inches (0.36 mm), and a pin center-to-center spacing of 0.045 inches (1.14 mm)) to shape the sheet, a die gap of 0.059 inches (1.5 mm) and a rollstack with chill rolls to solidify the extruded sheets and a winder to wind the sheets. Plant air is supplied by the air line with a flow meter and is fully open prior to heating the machine to prevent the blockage of microcapillary pins by the back-flow of polymer melt. During experiments, the airflow rate is carefully adjusted in such a way that the channels 15 do not blow out, but instead maintain reasonable channel 15 dimensions. The temperature profile of the film cast line is provided in Table 2. The process conditions of the film cast line are reported in Table 3.

TABLE 2

Temperature profile of film cast line

| | |
|---|---|
| Extruder Zone 1 | 177° C. |
| Extruder Zone 2 | 213° C. |
| Extruder Zone 3 | 240° C. |
| Extruder Zone 4 | 240° C. |
| Adaptor Zone | 240° C. |
| Transfer Line | 240° C. |
| Screen Changer | 240° C. |
| Feed Block | 240° C. |
| Die Zone | 240° C. |

TABLE 3

| Process conditions of film cast line | |
|---|---|
| Chill Roll Temperature | 68.8° C. (145° F.) |
| Screw Speed | 22 rpm |
| Air Flow Rate | 150 ml/min |
| Line Speed | 73 m/min (4 ft/min) |
| Extrusion Pressure | 21.2 MPa (3080 psi) |
| Air Knife | 254 mm of water level (10 inches of water level) |
| Sheet Width (W) | 495 mm (19.5 inches) |

A microcapillary sheet 11 containing a matrix 14 with a polymeric material having 80 wt % ELITE™ 5100G and 20 wt % LDPE 501I, based on the total weight of the matrix 14, is produced. The microcapillary sheet 11 has a thickness, T, of 800 μm. The microcapillary sheet 11 has 70 channels 15 dispersed in parallel in the matrix 14. The channels 15 have an oval cross-sectional shape. The short axis, X, of each channel 15 is 361 μm. The diameter, D, (i.e., the long axis) of each channel 15 is 1028 μm. The spacing, S, of matrix 14 (polymeric material) present between the channels 15 is approximately 116.6 μm.

The microcapillary sheet 11 is 31.5 vol. % of channels 15 and 68.5 vol. % matrix 14, based on the total volume of the microcapillary sheet 11.

2. Microcapillary Sheet Absorption Testing

A microcapillary sheet 11 having a length, L, of 300 mm, a width, W, of 65 mm, and a thickness, T, of 800 μm is cut from the microcapillary sheet produced on the film cast line. The microcapillary sheet 11 has 70 channels 15 dispersed in parallel in the matrix 14. The microcapillary sheet 11 has a total volume of 15.6 $cm^3$. The microcapillary sheet 11 has a total channel 15 volume of 4.91 $cm^3$. Thus, the microcapillary sheet is 31.5 vol. % of channels 15 and 68.5 vol. % matrix 14.

The microcapillary sheet is perforated to have a continuous perforation 16 from a first side 20*a* to the opposing second side 20*b* of the microcapillary sheet 11 using a 0.1 mm thick steel razor saw. The continuous perforation 16 traverses each channel 15 of the microcapillary sheet 11 and is located equal distance from the first end 12*a* and the second end 12*b* of the microcapillary sheet 11. The perforation 16 has a height, H, of 400 μm (50% of the thickness, T, of the microcapillary sheet). The microcapillary sheet is inspected under a magnifier to ensure the channels 15 are fully exposed, meaning the interior 25 of the channel 15 is in fluid communication with ambient environment.

The perforated microcapillary sheet is weighed with a Semi-analytical scale with +/−0.01 g precision. The weight of the perforated microcapillary sheet is 9.80 grams.

A 5 milliliter hypodermic syringe is filled with 70% distilled water/30% ethyl alcohol (volume by volume) and 1 drop of blue dye to facilitate the observation. The ethyl alcohol reduces surface tension of the liquid and the blue dye increases visual contrast to facilitate observation. The syringe is filled to the limit (5 ml).

The microcapillary sheet 11 is placed in a flat horizontal position and the full contents of the syringe (5 ml, 3.59 grams) are applied over the perforation 16 during a period of 12 seconds. The liquid is readily drawn through the perforation 16 to the interior 25 of the channels 15 by capillary action. A small excess of liquid present on top of the perforation 16 is removed with an absorbing paper and the microcapillary sheet 11 is weighted again, showing a weight of 13.22 grams. Therefore, the microcapillary sheet 11 draws in and retains 3.42 grams of liquid (4.76 ml), corresponding to 95.3 wt % of the total liquid mass applied and 95.3 vol. % of the total liquid volume applied.

3. Tray Formed from a Microcapillary Sheet

A microcapillary sheet 11 is cut from the microcapillary sheet produced on the film cast line. The microcapillary sheet is thermoformed to form a tray by (i) reheating the microcapillary sheet and then (ii) molding the microcapillary sheet into a tray form. During the reheating step, infrared (IR) heaters are set to a predetermined temperature (ranging from 190° C. to 220° C. for the microcapillary sheet containing a matrix 14 with a polymeric material having 80 wt % ELITE™ 5100G and 20 wt % LDPE 501I). A piece of microcapillary sheet is placed on a sheeting holder between two arrays of IR heaters to quickly obtain uniform reheating. The reheating time is from 10-30 seconds, with the microcapillary sheet temperatures ranging from 70° C. to 100° C., respectively. After the reheating process is complete, the sheeting holder is moved from between the two arrays of IR heaters to between upper and lower molds of a thermoformer. The upper and lower molds immediately move towards each other and clamp together to reach a pre-set pressure (5-25 bar). Subsequently, the molds are opened and the tray is removed from the sheeting holder.

It is specifically intended that the present disclosure not be limited to the embodiments and illustrations contained herein, but include modified forms of those embodiments including portions of the embodiments and combinations of elements of different embodiments as come within the scope of the following claims.

We claim:

1. A food package comprising:

a microcapillary sheet having a first end and a second end and opposing surfaces, the microcapillary sheet comprising (i) a matrix comprising a polymeric material;

(ii) a plurality of channels disposed in parallel in the matrix and between the opposing surfaces, the channels extending from the first end to the second end, the matrix does not absorb liquid;

(iii) a perforation traversing at least two channels, the perforation extending from a surface and through a wall of the at least two channels.

2. The food package of claim 1 wherein the microcapillary sheet has a contact angle from 0° to less than 90°.

3. The food package of claim 1 wherein the perforation defines a scored surface, the food package comprising a food item in contact with the scored surface.

4. The food package of claim 3 wherein liquid from the food item passes through the perforation and into an interior of the channels.

5. The food package of claim 3 comprising a tray, the microcapillary sheet located on a base of the tray.

6. The food package of claim 1 wherein the microcapillary sheet comprises a first side and an opposing second side, and the perforation extends from the first side to the second side.

7. The food package of claim 1 comprising an antimicrobial material dispersed through the matrix.

8. The food package of claim 1 comprising a coating comprising an antimicrobial material located on at least a portion of a surface.

9. The food package of claim 1 wherein the perforation has a V-shape from a cross-sectional view.

10. The food package of claim 1 comprising a film layer located on at least a portion of a surface of the microcapillary sheet, the film layer comprising an antimicrobial material.

11. The food package of claim 1 wherein the polymeric material comprises an ethylene-based polymer, a propylene-based polymer, or combinations thereof.

12. The food package of claim 11 wherein the polymeric material comprises a low density polyethylene and an ethylene/α-olefin copolymer.

13. The food package of claim 1 wherein the food package excludes an absorbent pad.

14. The food package of claim 1 wherein the food package further includes an absorbent pad.

15. A food package comprising:

a tray comprising a base and a plurality of walls extending upward from the base, the tray formed from a microcapillary sheet having a first end and a second end and opposing surfaces, the microcapillary sheet comprising (i) a matrix comprising a polymeric material, the matrix does not absorb liquid;

(ii) a plurality of channels disposed in parallel in the matrix and between the opposing surfaces, the channels extending from the first end to the second end; the base comprising (iii) a perforation traversing at least two channels, the perforation extending from a surface and through a wall of the at least two channels; and a trough extending along a perimeter of the base.

16. The food package of claim 15 wherein the microcapillary sheet has a contact angle from 0° to less than 90°.

17. The food package of claim 15 wherein the walls extend upward from the base along the trough.

18. The food package of claim 15 wherein each channel has an exposed end at the trough.

19. The food package of claim 15 wherein the perforation defines a scored surface, the food package comprising a food item in contact with the scored surface.

20. The food package of claim 15 comprising a coating comprising an antimicrobial material located on at least a portion of a wall of a channel.

* * * * *